US005918839A

United States Patent [19]

DuBois

[11] Patent Number: 5,918,839

[45] Date of Patent: Jul. 6, 1999

[54] WRIST AND ARM SUPPORT

[76] Inventor: Craig R. DuBois, 1106 Kennan Rd., Austin, Tex. 78746

[21] Appl. No.: 08/507,854

[22] Filed: Jul. 27, 1995

[51] Int. Cl.[6] ..... B68G 5/00

[52] U.S. Cl. ..... 248/118; 248/118.1

[58] Field of Search ..... 5/653, 654, 646, 5/647, 623; 248/118, 118.1, 118.3, 118.5, 918

[56] References Cited

U.S. PATENT DOCUMENTS

| | | | |
|---|---|---|---|
| D. 345,422 | 3/1994 | Spence, Jr. | D24/194 |
| D. 345,608 | 3/1994 | Spence, Jr. | D24/194 |
| 3,234,623 | 2/1966 | Rector | 248/118 |
| 4,043,330 | 8/1977 | Bansal | 248/118 |
| 4,643,481 | 2/1987 | Saloff | 5/653 |
| 4,779,296 | 10/1988 | Bond | 5/646 |
| 4,973,176 | 11/1990 | Dietrich | 400/715 |
| 5,072,905 | 12/1991 | Hyatt | 248/118 |
| 5,125,606 | 6/1992 | Cassano et al. | 248/118 |
| 5,131,614 | 7/1992 | Garcia et al. | 248/118 |
| 5,143,341 | 9/1992 | Juster | 248/118 |
| 5,158,255 | 10/1992 | Fuller | 248/118 |
| 5,163,646 | 11/1992 | Engelhardt | 248/118 |
| 5,418,991 | 5/1995 | Shiflett | 5/647 |
| 5,476,491 | 12/1995 | Mayn | 248/118 |
| 5,601,264 | 2/1997 | Peart | 248/118.1 |

*Primary Examiner*—Ramon O. Ramirez
*Assistant Examiner*—Gwendolyn W. Baxter

[57] ABSTRACT

A supporting device for wrists, hands, forearms and elbows which is capable of providing support and differential compression to the soft tissue and neural tissue of the wrists, hands, forearms, and elbows without direct compression. The device is for use with a keyboard, mouse or repetitive assembly tasks which can be oriented in various positions to the body of the user. The supporting device of the present invention is composed of a nodal section containing three raised nodes which are each separated by an internodal recess and a rim section to forming a central cavity. The central cavity of the supporting device can optionally contain a cushion, containing a soft polymeric material which provides a further differential supportive structure. The supporting device is also designed and intended to be subjected to thermal differences which will provide additional therapeutic benefits to the user.

5 Claims, 6 Drawing Sheets

WRIST AND ARM SUPPORT

BACKGROUND OF THE INVENTION

1. Field of the Invention

The present invention relates to a wrist, forearm, and elbow supporting device to be used when using a keyboard or a mouse or when performing tasks in an assembly process requiring the use of the hands in front of the user or requiring resting the elbows, forearms and/or the wrists on a table. The device is designed to reduce pain and tenderness which develops in the neck, shoulder, forearm, wrist, and hand region of individuals who are performing repetitive tasks.

2. Background Information

With the increased use of separate keyboards, such as those used with personal computers, greater numbers of office personnel have been experiencing problems with their hands, wrists, forearms, shoulders, necks, and backs. One of the most common of these problems has been called carpal tunnel syndrome, which causes numbness, tingling, and loss of strength in the hands and wrists.

The carpal tunnel is an area that is situated at a point approximately midway between the two lower arm bones, the ulna and the radius, and below the multiple wrist bones. Thus, the wrist bones form the top surface of the tunnel and the ulna and radius form the side walls of the tunnel. The carpal tunnel is a common region for localized pain, inflammation, strain, and injury because it is the location of both the median nerve and the associated flexor tendons, as they pass from the forearm to the fingers.

In an effort to relieve some of the symptoms associated with increased keyboard use, a number of support devices have been developed to support the hands and the wrists when using a keyboard. These devices have been designed to allegedly help release the pressure and vibration on the nerves and associated tendons passing through the carpal tunnel.

Generally most of these support devices are elongated, flat, padded wrist supports that are placed parallel to the longitudinal axis of the keyboard. The user places the wrists on the support while using the keyboard. The surfaces of these devices support the wrists by having the entire ventral surface of the wrists in contact with the supporting device. These devices do not provide a means to relieve the direct constant pressure to the area of the carpal region and do not provide the means of support needed to reduce the pressure and compression on the median nerve and its associated tendons. Examples of such "constant pressure devices" are disclosed in U.S. Pat. Nos. 5,072,905; 5,125,606; 5,131,614; 5,163,646; and 4,973,176.

The supporting device of the present invention has specific design features to distinguish it from the prior art devices. These unique features provide support for the arm by contacting only particular support structures of the body which are not subject to pressure and compression; and yet provide a specific selective means of supportive contact with other parts of the body which are not subject to pressure and compression. Thus, the present invention provides an improved support device which is used to support the hand, wrist, forearm and upper arm area of a user in a unique way without subjecting soft tissues and neural tissues to pressure and compression, thereby reducing pain and tenderness which results from performing repetitive tasks involving the fingers, wrists, forearms and arm muscles.

SUMMARY OF THE INVENTION

The present invention provides a supporting device for hands, wrists, forearms, and elbows for use by an individual performing repetitive tasks, such as using a keyboard or performing an assembly process.

The present invention additionally provides a supporting device for hands, wrists, forearms, and elbows with a unique configuration which takes into account specific features of human anatomy and neurophysiology to reduce pain, inflammation, strain, and injury and relieve pressure and compression to neurovascular and tendinous ("soft tissue") structures.

The present invention also provides a supporting device which can be positioned to obtain differential degrees of support in the soft tissues and to concomitantly provide for maintenance of a desirable degree of wrist flexion-extension angle and pronation-supination angle while using a keyboard.

The present invention further provides a supporting device which supports the hands and wrists in a unique manner by cradling the median nerve and associated flexor tendons.

The present invention also provides a supporting device that is flexible in nature, and capable and tolerant of torsion, and is able to be easily displaced in a rolling and torquing type of motion and thus moves with the user when an anterior or forward reaching type of motion of the arm is made while the arm is still resting on the device such that the device provides variable relief of pressure without restricting or immobilizing the user's wrist, hand, or arm from being moved.

The present invention additionally provides a supporting device which also supports the forearms and elbows when the individual is performing repetitive tasks which requires resting the elbows, forearms, or hands on the worktable surface.

The present invention further provides a supporting device which when used either in a more proximal location to the body of the user, such as on the forearm or when used in sets of four can be used to support the hands, wrists, forearms, and elbows more collectively by placing a supporting device under each wrist and under each forearm or elbow.

The support device of the present invention differs from the prior art devices in its configuration and its enhanced ability to offset and relieve direct pressure on the median nerve and associated tendons. The prior art devices were designed to reduce stress and to provide support for the nerves and tendons in the wrist and forearm; however, all of these devices provide a flat support which, as noted above, produce constant pressure to be exerted on the median nerve and its associated flexor tendons.

The design and configuration of the supporting device of the present invention provides a wrist support which cradles the median nerve and the associated flexor tendons which pass through the carpal tunnel rather than applying constant and full pressure on this area of the wrist. There is a specific relationship between the median nerve and the tendons at the wrist and the points of support in the supporting device of the present invention.

The support mechanism of the present invention provides an anatomically advantageous means of supporting the area known as the carpal tunnel by using the bony sidewalls of the carpal tunnel formed by the ulna and the radius in the wrist region as the key structures supporting the weight of the arm. The present supporting device does place pressure on the wrist but the pressure from the weight of the arm is on the firm body areas that overlie the bony prominence of both the lateral and medial aspects of the wrist. That is, the present supporting device takes specific advantage of the presence of the tough sidewalls of the carpal tunnel to provide support rather than the softer, more compressible nervous system, and tendinous and synovial tissue which is located in the central or middle aspect of the wrist and which is directly affected by compression directed from directly below or ventral to this tissue area. This type of direct compression is imposed by the non-differential supporting devices of the prior art. The lateral sidewall region of this area of the body contains very few tendons or ligamentous elements that are actively used in arm/hand actions; such as typing and keying functions. By specifically placing a greater portion of the pressure or support of the arm on this area, direct compressive force is reduced upon the central nerves, tendons, and tissues which are actively involved in repetitive manipulative actions involving the hands. The shifting of these pressures reduces the likelihood of developing compression related tendinitis and soft tissue inflammation in the area of the body affected by the carpal tunnel syndrome.

The alternate use of the supporting device as a support for the forearms and elbows requires that the device be positioned lengthwise or longitudinally to the body of the user. The supporting device placed in this position provides support for nerves, muscles and soft tissues in the forearm. Likewise, such support can also be applied to other bodily parts not specifically discussed here, but that have similar anatomical features and principles.

The present inventor has developed a device for supporting the hands, wrists, forearms and elbows of a user which cradles the soft tissues and neural tissues of these body parts; and which does not apply direct pressure and does not compress these tissues. The present supporting device can satisfy a multitude of user needs by providing variable localization of support pressure with the same device yet still providing differential soft tissue compression and support. The present supporting device provides anatomically designed pressure relief zones for soft tissue compression via differential compression relief and support for soft tissue and nervous tissues of and around the wrist, elbow and olecranon area. The present supporting device provides circumferential support of the elbow thereby removing the direct compression on this area. No other known device provides support around the elbow.

The device of the present invention in its simplest form contains a nodal section composed of a resilient material and containing at least two raised nodes separated by an internodal recess. The device is designed to support the hands, wrists, forearms, and elbows at contact points on the nodal section without direct compression of the soft, compressible tissues of the hands, wrists, forearms, and elbows. The wrist, for example, is positioned on the supporting device over the internodal recess which cradles the wrist by holding it in the sloping sides coming off of the raised nodes, and not allowing the entire ventral surface of the wrists to come in contact with the nadir of the internodal recess, thus preventing directed compression on the ventral surface of the wrist.

The nodal section may form a continuous ring forming a central cavity. This configuration contains at least five raised nodes, each of which are separated from each other by internodal recesses and which may be of same or different heights.

The nodal section containing at least two raised nodes separated by an internodal recess may be attached to a rim section which is a generally flat section with at least two depressions. The joining of the nodal section to the rim section forms a central open cavity. This type of configuration of the supporting device of the present invention is preferred. The wrist may rest in one of the internodal recesses with the forearm resting in one of the depressions of the rim section. This type of configuration also prevents directed compression on the ventral surface of the wrist.

The supporting device is mobile and does not require attachment to any equipment. The device can freely move and be placed in almost any desired position by sliding it on the worktable area as desired by the user. The device allows free movement to and from a position in front of a keyboard, both tangential and perpendicular to the keyboard's longitudinal axis without restriction. No other device provides support of both the wrist flexion and the supination angles to the wrist and forearm and provides the ability to freely move about in two or three dimensional rotational moments or angles. The device allows the user to maintain the natural and/or desired placement or angles of the user's shoulders, elbows, wrists and hands during all activities and motions at a keyboard.

The device is capable of providing support when using a keyboard, keypad, mouse, stylus or ordinary writing implement, such as a pen or pencil. The supporting device encourages the user to move from one place on the work area to another, thereby eliminating the constant application of pressure on the same area of the arm. The device may be affixed to a work stand, table, machinery or prosthesis device to provide a variety of different uses. The device may be placed upon either a slick or sticky type of base material to enhance or inhibit the degree of mobility of the device. Further, the device may be placed upon a small supportive device for restricting or limiting its mobility in such settings, where this may be desired. For example, on an angled work station or table, the central cavity of the device could be placed on a small raised area which would prevent the device from sliding freely or falling off of the angled station or table. Additionally, a rotating bearing or rotational slide device could be used to keep the device in a single area, or to affix the device to other means or structures to assist in mobility.

The device is not abrasive to the skin of the user when the device is moved around on the worktable area. The supporting device may optionally be covered in a material, such as a cloth cover.

DETAILED DESCRIPTION OF THE PREFERRED EMBODIMENT

The supporting device of the present invention will now be described in detail with specific reference to FIGS. 1–6, which are examples of the preferred embodiments of the present invention. While the invention will be described in detail in conjunction with these embodiments, it will be understood that they are not intended to limit the invention to those embodiments.

Figure 1A:
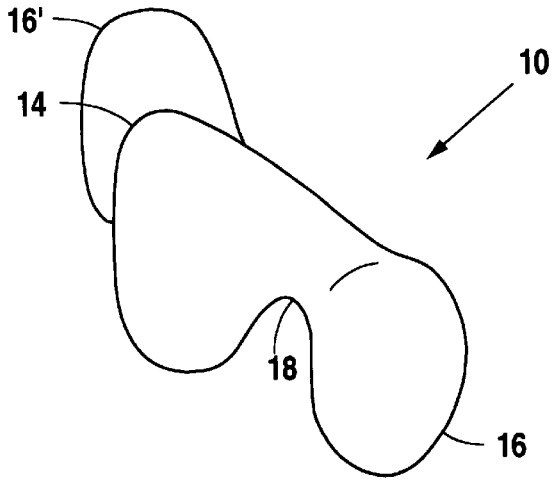
FIG. 1A is a perspective view of one of the supporting devices of the present invention.
Figure 1B:
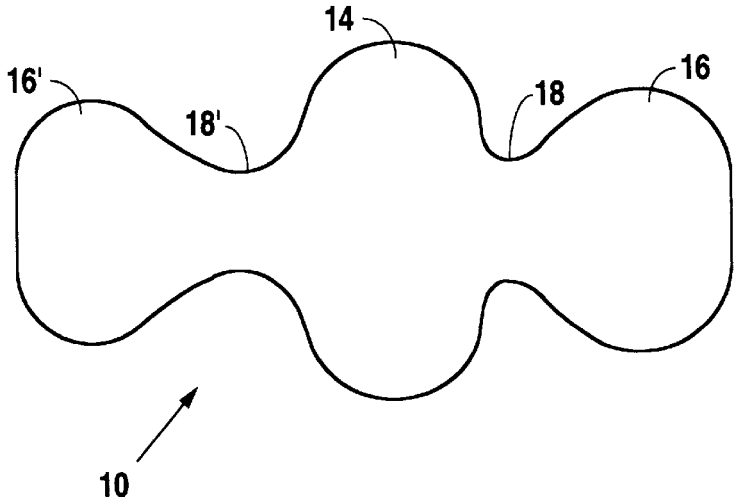
FIG. 1B is a front view of the supporting device in FIG. 1A of the present invention.

The supporting device of the present invention in its simplest form is depicted in FIGS. 1A and 1B showing the supporting device (10) having three raised nodes (14), (16), and (16') which are each separated by an internodal recess (18) and (18'). The general shape of device (10) is slightly curved with the projection of the three raised nodes extending outwardly. The three raised nodes are specifically a middle node (14) having a first height and two lateral nodes (16) and (16') having a second height. The first height of the middle node (14) is greater than the second height of the two lateral nodes (16) and (16'). This configuration is preferred because it tilts the hand at the wrist slightly in the supinated position which is a preferable position for relief of wrist, elbow, shoulder, and neck strain over an extended period of time. As can be seen in FIGS. 1A and 1B, the device (10) does not rest flatly on the surface as a result of the connection of the nodes through the internodal recesses, which do not contact the surface. If the device (10) is rotated 180 degrees, the contact with the surface is the same. However, device (10) can be cut in half lengthwise, shown as device (10') in FIG. 1C forming a half shell. In this embodiment, the device (10') rests flatly on the surface. The device (10') is used in the same manner as the device (10) except that it could have a lower overall height because it represents one half of device (10).

A perspective view of the preferred supporting device (20) of the present invention is shown in FIG. 2A and 2B and FIGS. 3A–3D provide top, front, back, and side views of this device. The supporting device (20) is composed of a generally circular body having a nodal section (22) having three raised nodes (24), (26), and (26') which are each separated by an internodal recess (28) and (28'). The nodal section (22) is attached to a rim section (30). The attachment of the nodal section (22) to the rim section (30) forms a central cavity (32).

Figure 2A:
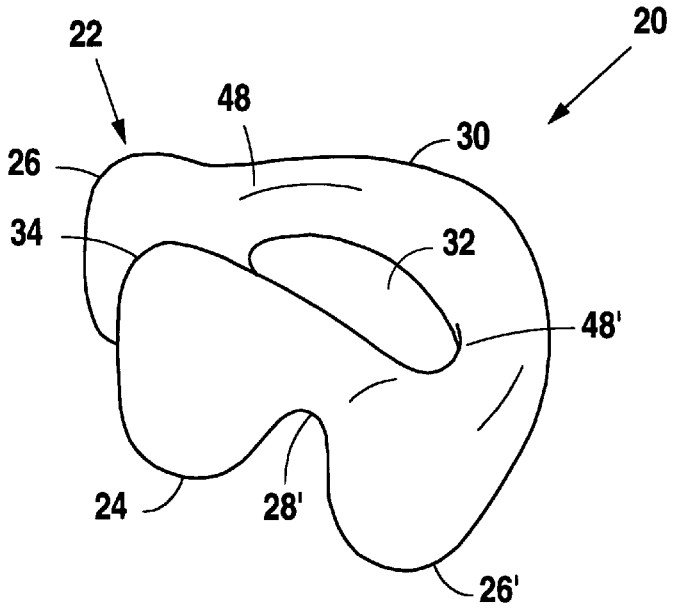
FIG. 2A is a perspective view of the preferred supporting device of present invention.
Figure 2B:
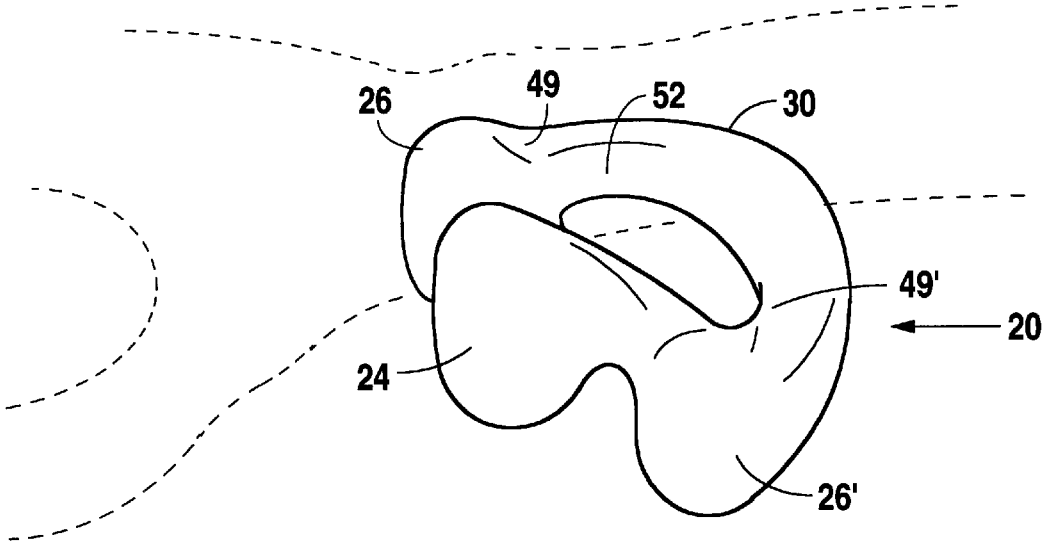
FIG. 2B is a perspective view of the preferred supporting device of the present invention with a wrist resting in the preferred orientation of the device.
Figure 3A:
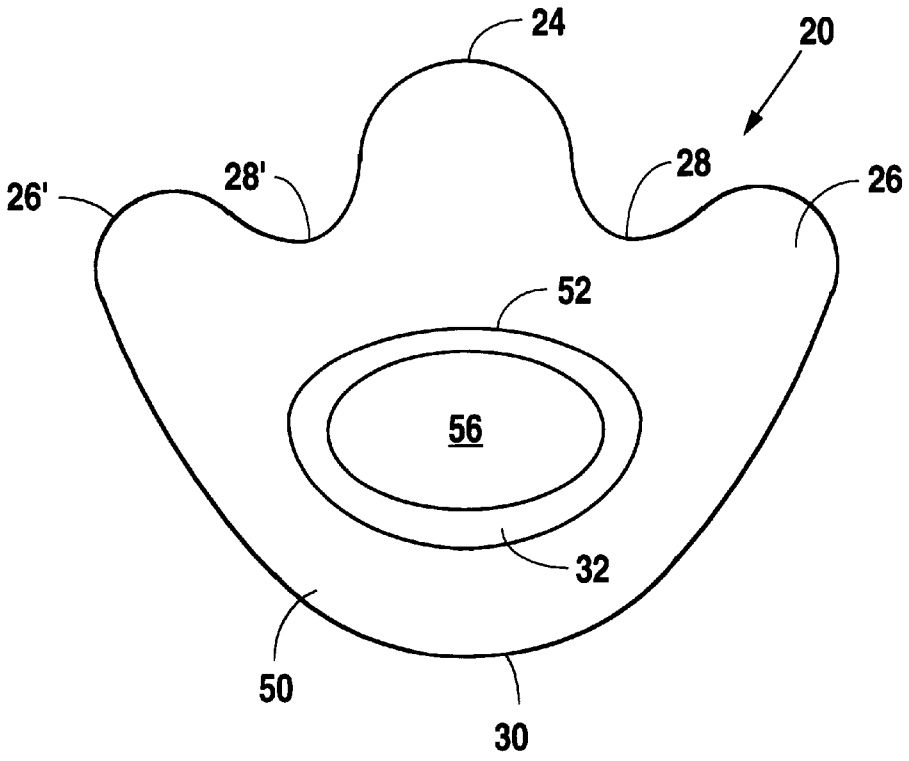
FIG. 3A is a top view of the supporting device of FIG. 2A of the present invention.
Figure 3B:
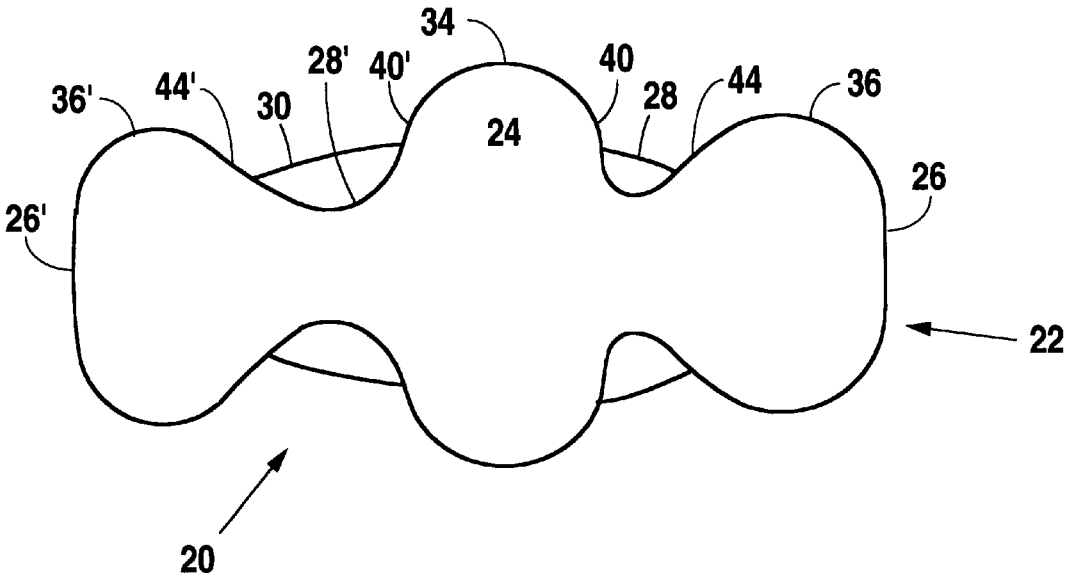
FIG. 3B is a front view of the supporting device of FIG. 2A of the present invention.
Figure 3C:
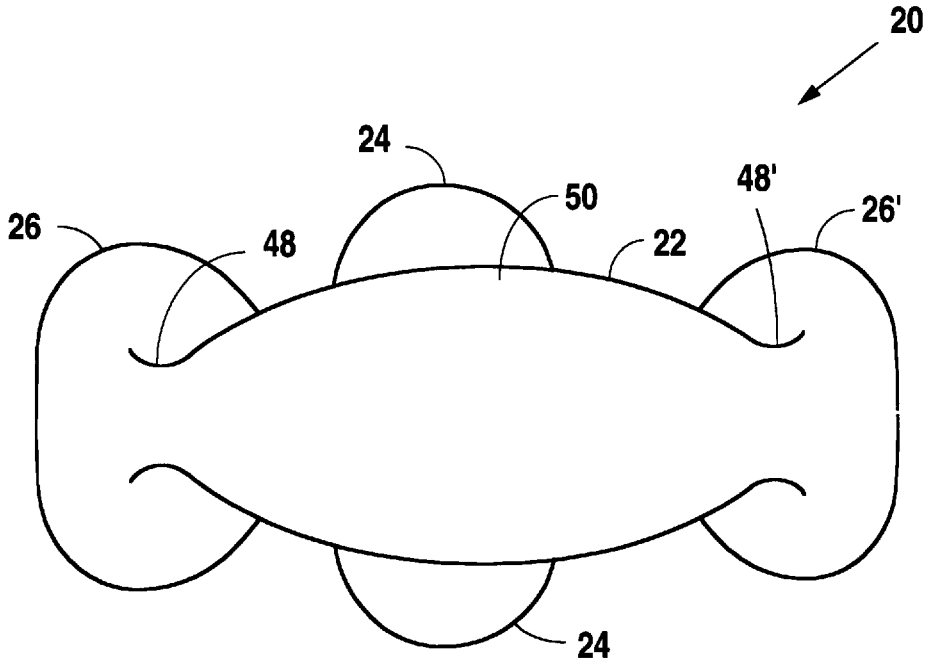
FIG. 3C is a back view of the supporting device of FIG. 2A of the present invention.
Figure 3D:
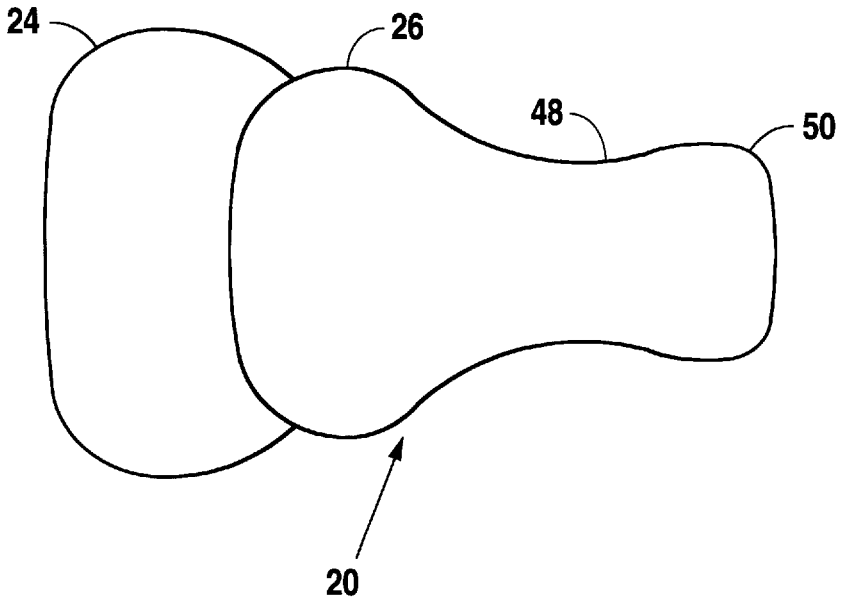
FIG. 3D is a side view of the supporting device of FIG. 2A of the present invention.

The three raised nodes are specifically a middle node (24) having a first height and two lateral nodes (26) and (26') having a second height. The first height of the middle node (24) is greater than the second height of the two lateral nodes (26) and (26'). This configuration is preferred because it tilts the hand at the wrist slightly in the supinated position which is a preferable position for relief of wrist, elbow, shoulder, and neck strain over an extended period of time. Preferably, the height ratio of each of the lateral nodes (26) and (26') to the middle node (24) is in the range of 3:3.5 to 3:5 with the median ratio being approximately 3:4. The dimensions of the nodes are not critical as long as the nodes are able to cradle the wrist of the user in one of the internodal recesses (26) or (26') as shown in FIG. 2B. It is preferred that the middle node (24) is greater in height than the two lateral nodes (26) and (26') resulting in a slight rotation of the wrist. The middle node (24) extends outwardly or anteriorly from the device (20) in the range of about 0.5 to 1.25 inches further than either of the lateral nodes (26) and (26') with the median length being approximately 0.75 inches.

The two lateral nodes (26) and (26') are angled outwardly from the supporting device (20) providing a smooth flowing continuous line from the rim section (30). This angularity of the supporting device (20) supports the natural angularity of the wrists when a user is sitting at a keyboard. The natural angularity of the forearms from the elbows in this position angles the wrists slightly inward or medially, and this natural angularity of the wrists is supported perfectly by the supporting device (20).

The distance between the apex (34) of the middle node (24) to each of the apexes (36) and (36') of the lateral nodes (26) and (26') is preferably different to accommodate different sizes of wrists of the different users. This distance can be varied to sizes which would accommodate most users. The preferred supporting device (20) has a distance of 55 mms between the apex (36) of one lateral node (26) and the apex (34) of the middle node (24) and a distance of 63 mms between the apex (36') of the other lateral node (26') and the apex (36) of the middle node (24). The preferred supporting device (20) as well as the device (10) is designed so that it can be turned laterally 180 degrees to its other side to provide a different dimensional aperture of support to accommodate a different user's anatomical dimensions and needs. This orientation now positions the supporting device so that the internodal recesses with the different distances of either 55 mms or 63 mms, can be positioned laterally with respect to the body of the user. The distances of 55 and 63 mms are the preferred distances between apexes of the preferred embodiment because they are believed to be able to comfortably accommodate the wrists of the majority of users of the device, but the preferred distances are not meant to limit the present invention to a supporting device with specific dimensions. The distance between the nodes should be sufficient to cradle the wrist of the user without putting pressure on the region of the median nerve.

The middle node (24) has two sloping sides (40) and (40') extending from the apex (34) of the middle node (24) toward the internodal recesses (28) and (28'), respectively. The lateral node (26) also has a sloping side (44) extending from the apex (36) of the lateral node (26) toward the internodal recess (28). Likewise, the lateral node (26') has a sloping side (44') extending from the apex (36') of the lateral node (26') toward the internodal recess (28').

The slope of the sloping sides of the middle and lateral nodes must be of a sufficient angle so that the wrist does not fully rest against an internodal recess (28) and (28') which would place pressure on the region of the median nerve. The contact points of the wrist along the sloping sides of the nodes are responsible for holding the wrist above the internodal recesses (28) and (28'). The slopes of the sloping sides (40), (40'), (44) and (44') can range from approximately 5 degrees to 80 degrees, but a midpoint angle along a sloping side of 45 degrees is preferred. The slopes of the sloping sides may have the same angles or these angles may be vary within the same device.

The rim section (30) contains two depressions (48) and (48') located adjacent to the two lateral nodes (26) and (26'), respectively. Preferably, the length of depressions (48) and (48') are different. The length of these depressions (48) and (48') can range from 0.6 to 2.2 inches in length, with a preferred length of approximately 1.5 inches. The length of the depressions (48) and (48') are preferably different to accommodate different size forearms of the users, with the length staying within the 0.6 to 2.2 inch range. The depth of these depressions (48) and (48') can range from 0.1 to 0.4 inches, with a preferred depth of approximately 0.14 inches.

A raised convex curve (50) of the rim section (30) is created by and between the two depressions (48) and (48') forming a smaller equivalent of a node/internodal relationship. The raised convex curve (50) is located directly across from the middle node (24) and forms a side of the rising walls of the central cavity (32) which can hold the forearm. Directly across from the raised convex curve (50) is a hollow (52) which is formed on the rising wall formed by the curve of the nodal region (22) which results from the interconnection of midpoints of the nodes and the internodal recesses. The actual curve of this hollow (52) is quite complex because its depth and breadth is demarcated by the slopes of the descending nodes (24), (26) and (26'). This hollow (52) is also formed by the confluence of several other portions of the device (20).

Figure 1C:
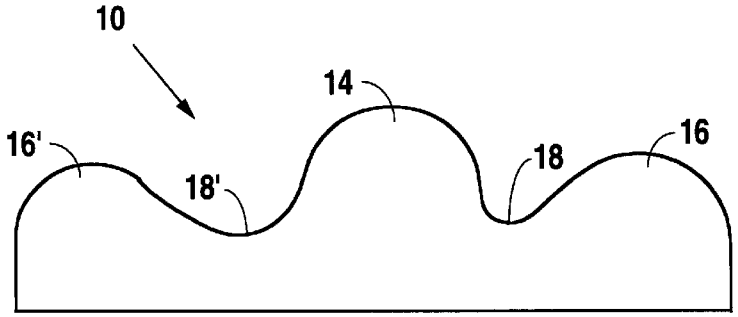
FIG. 1C is a front view of a half shell of the supporting device of FIG. 1A of the present invention.
Figure 4:
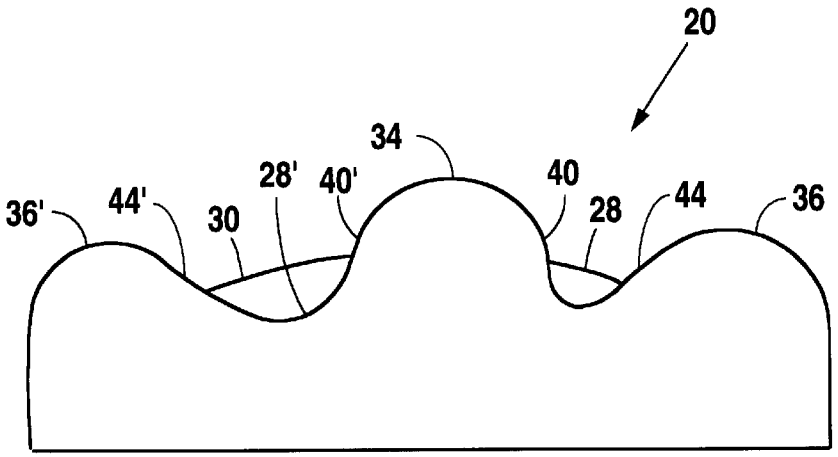
FIG. 4 is a perspective view of a half shell of the supporting de ice of FIG. 2A.

As shown in FIG. 1C for device (10), device (20) can also be cut in half longitudinally forming a half shell of this configuration of device (20'), shown in FIG. 4, allowing the device to lay flat on a surface.

The shape of the supporting device (20) is also designed to allow its use in a number of different locations on the body. The shape of the supporting device (20) of the present invention provides greater flexibility to the user to fit individual preferences and comfort.

FIG. 2B shows the preferred orientation for use of the supporting device (20) as a wrist rest. In this orientation, the nodal section (22) is orientated away from the user, which will cause the distal portion of the wrist to be vertically higher than the proximal portion of the wrist. This orientation promotes the natural wrist angularity. In the opposite orientation from that shown in FIG. 2B, the nodal section (22) is oriented toward the user, and there will be an opposite effect causing the proximal portion of the wrist to be higher than the distal portion of the wrist, providing a different approach height and angulation of the user's forearm to wrist/hand angle to accommodate different user needs.

These standard positions may then be altered as needed and desired by the user with placement of the nodal section (22) or rim section (30) under portions of the hand-wrist-arm area as deemed comfortable to the user, with the corresponding rotation and angulation providing the necessary support.

These different orientations can be used to provide a comfortable fit to the user as well as providing the flexibility of integrating the supporting device with the height of the keyboard, work station, or mouse that is being used.

For use at a keyboard or with a mouse, the supporting device is used by placing the wrist between the middle node (24) and one of the lateral nodes (26) or (26') as shown in FIG. 2B for the right hand and oppositely oriented for the left hand. Or alternatively, the thumb portion of the hand can extend out of one of the internodal recesses (28) or (28') with the palm of the hand cupped over one of the lateral nodes (26) and (26') with the carpal tunnel remaining over the central cavity (32). The sloping sides of the middle node (24) and the lateral nodes (26) or (26') respectively hold the bottom of the wrist above the nadir of the internodal recesses (28) or (28'), protecting the median nerve and associated flexor tendons from being directly compressed.

Figure 5:
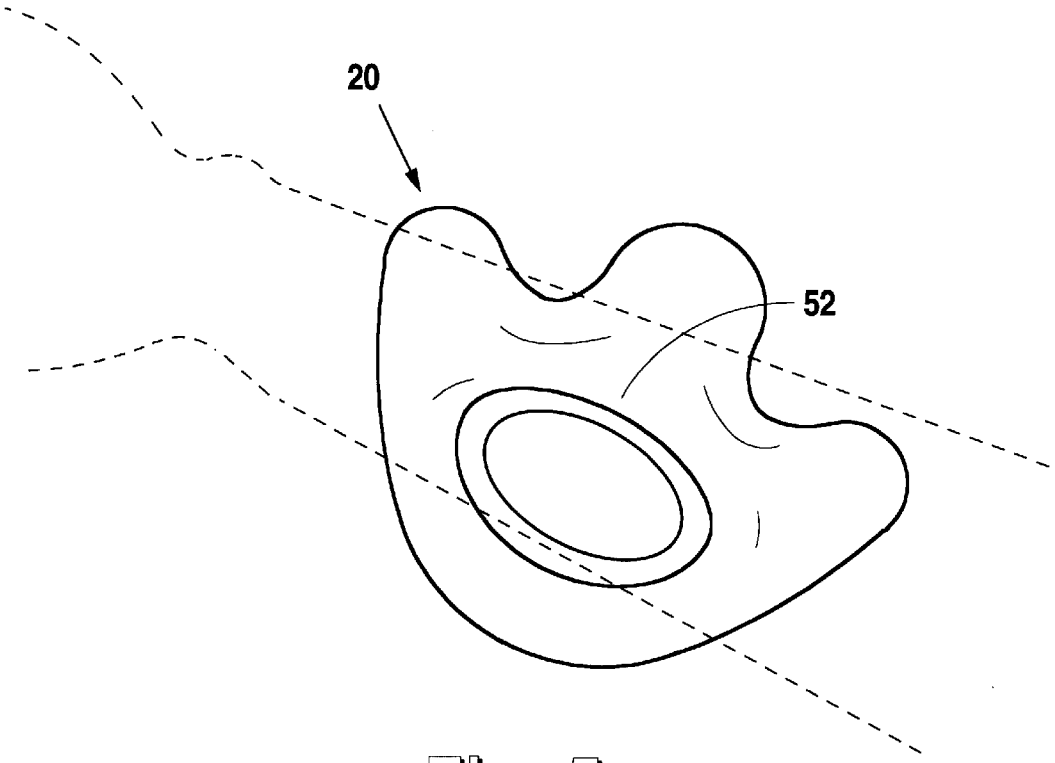
FIG. 5 is a perspective view of the supporting device of the present invention with a forearm resting in the preferred orientation.

In addition to using either of the supporting devices (10) or (20) as a wrist support, these supporting devices can also be used to support the forearm and elbow of the user either as an additional support to a pair of devices used to support the wrists when using a keyboard or mouse or as the primary support for the forearm and elbow when the user performs keyboard work or repetitive assembly tasks. To be used in this manner, the supporting device (20) is placed in a longitudinal orientation to the user with a side of one of the lateral nodes (26) or (26') oriented toward the user and the nodal section (22) extending laterally away from the body of the user as shown in FIG. 5. The supporting device (20) may be turned laterally to the longitudinally opposed position with the nodal section (22) extending laterally towards the body. Either of these orientations provides support for the forearms or elbows.

In the orientation in FIG. 5, the forearm is positioned against the hollow (52) formed by the curvature of alignment created along the bottom of the middle (24) and two lateral (26) and (26') nodes where they originate from the nodal section (22) of the supporting device (20). The hollow (52) provides support to the forearm flexor bundle known generally as the ulnar wrist flexors. The slope of the curve coming down from the nodes (24), (26), and (26') to the hollow (52) opposite the rim section (30) and continuing onto the rim section (30) toward the depressions (48) and (48') before rising again medially at the raised convex curve (50) of the rim section (30) is important in providing support to the forearm.

Another factor affecting the function of the hollow (52) is the consideration that the degree of the slope coming down to the hollow (52) is slightly different from each of the nodes (24), (26), and (261). The sloped curvature created by connecting the midpoints of the nodes in the nodal section (22) creates a relatively larger area in the middle portion of the hollow (52) to accommodate the muscles of the forearm flexor bundle, which should rest in this area when the supporting device (20) is used in this manner.

The supporting device (20) can be used in an alternate longitudinal orientation by longitudinally rotating the device (20) by 180 degrees longitudinally from the orientation shown in FIG. 5. The only change which this orientation offers is that the other alternate or opposed depression (48) or (48') will be oriented toward the body of the user. As discussed above, the length of these two depressions (48) and (48') are different. Device (20'), the half shell of device (20) shown in FIG. 4 can also be oriented in this manner. In this manner, the user can select the length of the depression which he desires to be oriented closer to his body for comfort purposes.

The supporting device (20) can alternatively be rotated laterally 180 degrees from the orientation shown in FIG. 5, which results in the lateral portion of the forearm resting on the rim section (30) lateral and away from the nodal section (22). In this orientation, the effect would continue to provide the same orientation of the depressions (48) and (48') as in FIG. 5. Likewise the device can be rotated longitudinally to provide different length depressions (48) and (48') located proximally versus distally to the body of the user. This position additionally rotates the arm to a greater supination angle. In this same orientation, the device (20) can be used as a support for the hand and wrist areas as well. Used in this position, the supination angle is supported by the region of the hollow (52), and the region of the base of the thenar prominence rests against either the base of the nodes (24, 26, or 26') or with the projection of the thumb extending through the area of the internodal recesses (28 or 28') and the hypothenar eminence projecting through the area of the longitudinal depressions (48 or 48').

In still a further extension of the use of the supporting device (20) of the present invention, a set of four supporting devices (20) can be used rather than a set of two. Using a set of four of the supporting devices provides a qualitatively different type of support than using a set of two. For this use, a supporting device (20) would be positioned longitudinally under the elbow or forearm and another supporting device (20) can be positioned transversely under the wrist of the same arm. This configuration of use allows the entire arm to be elevated slightly and to be more completely supported. This combined use of the supporting devices (20) for support of the forearms, elbows and the wrist protect the trunk and torso of the user by not requiring the use of the muscles of the neck and shoulders, that is, the trapezii, rhomboids, spinati, and deltoideus, to suspend and to carry the weight of the arms, which can become fatigued or tired and overly stressed by the act of supporting as well as moving the weight of the arms of the user while in the act of working at a keyboard.

Becoming fatigued, tired and overstressed produces and promulgates conditions commonly known as thoracic outlet syndrome and cervical-thoracic myofascial pain syndromes. The configurations herein also provide protection for the user's arm from compression and pressure neuropathy to the ulnar nerve, as well as from elbow bursal inflammation and pain from localized pressure to the elbow joint region.

The supporting device (20) of the present invention can be modified so that it may also be worn by the user by attaching the device to the user's arm, wrist, or elbow or placed on an apparatus which is attached to the user's arm, wrist, or elbow. The device (20) could be worn like a brace or orthotic device as well as a bracelet that is held in place by elastic band or a hook and loop type of fastening device.

Figure 6:
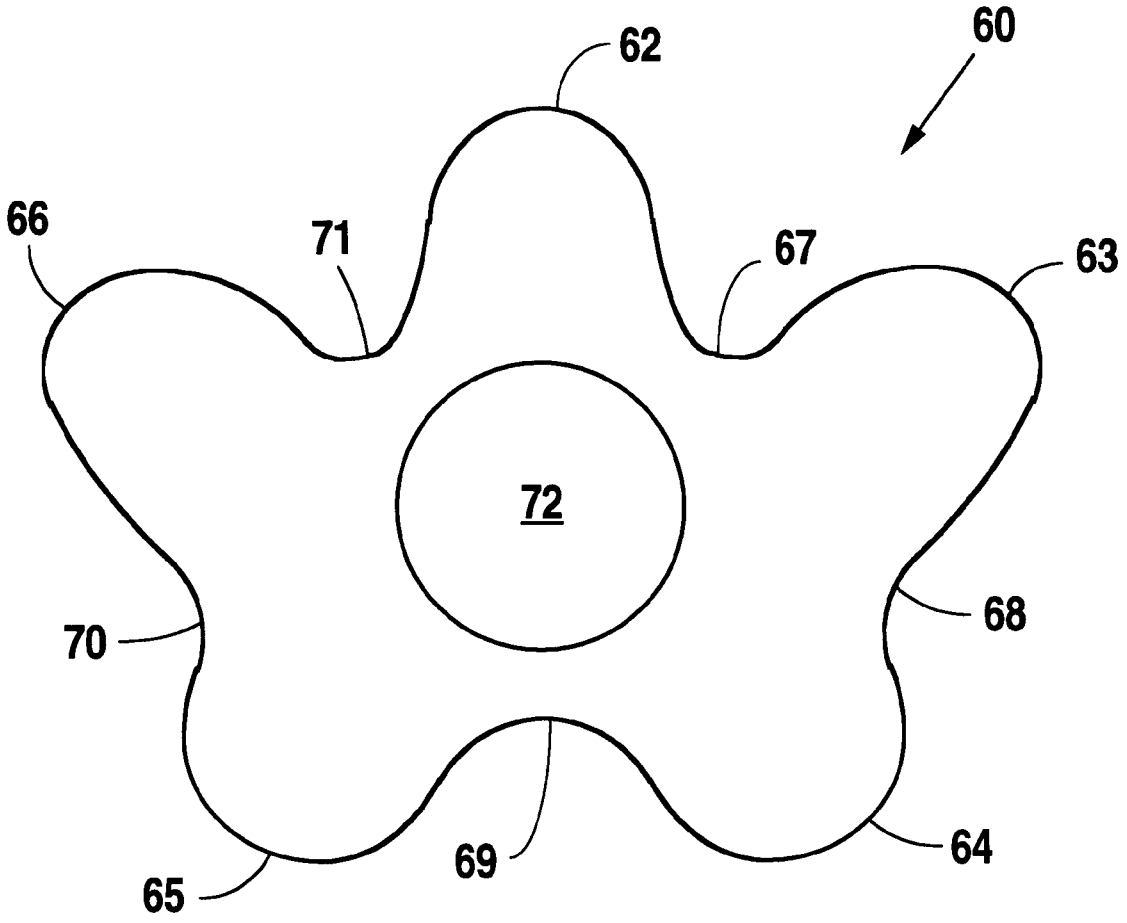
FIG. 6 is a perspective view of an alternate supporting device of the present invention.

FIG. 6 provides a alternate device (60) having a general polygonal shape, in which the entire device is a composed of a nodal section containing five nodes (62), (63), (64), (65) and (66) separated by internodal recesses (67), (68), (69), (70) and (71), which forms a central cavity (72). Node (62) is larger than the other nodes and is analogous to the middle nodes (14) and (24) in devices (10) and (20), respectively. The wrist and hand would rest on this device similarly as they rest on the device (20) with the forearm resting above the internodal recesses (68) or (70).

The supporting devices (10), (10'), (20), (20') and (60) of the present invention are preferably composed of a resilient material, which provides firm support on a flat surface yet is yielding. The material must be sufficiently hard to maintain the shape of the supporting device yet soft enough to yield to some extent under the weight of the wrist, hand, forearm, or elbow. The device is preferably composed of a resilient material, such as a gel material. The desired features of the supportive gel material are that it must provide sufficient support to the wrists, hands, forearms, and elbows which will be placed on the supporting device and yet it must provide sufficient elastic properties allowing it to yield when pressure is placed upon it. The material should also preferably be able to absorb or dampen vibrations. Further, the gel material should be capable of withstanding heat extremes of cold and heat.

The supporting devices of the present invention can be made of a shell filled with a gel material or can be made of a solid gel material. The preferred configuration of the supporting device is a soft, supple plastic shell containing a silicone based gel. Examples of gel materials which provide the required properties are a saturated ethylene-octene copolymer, such as ENGAGE EG 8100, a polyolefin elastomer and a registered trademark of The Dow Chemical Company, Midland, Mich., or ELVAX, a registered trademark of The Dupont Company, Wilmington, Del., resins composed of copolymers of ethylene vinyl acetate. The shell is filled with a liquid silicone rubber compound composed of mixtures of non-hazardous organopolysiloxanes, which can be purchased from GT-Products, Inc., Grapevine, Tex. under product names X-14094A and X14094B. These organopolysiloxanes can be mixed in different concentrations and crosslinked to different degrees to obtain a silicone compound with varying resiliency. These organopolysiloxanes can also be used to produce a solid supporting device of the present invention.

The central cavity (32) of the supporting devices (20) or (60) can optionally contain a cushion, such as a bag (56) containing a soft gel material. The soft gel material may be softer than the gel material from which the supporting device is made. This bag (56) provides a further differential supportive structure and is intended to provide greater weight bearing capacity than the supporting device alone.

The supporting device is also designed and intended to be subjected to thermal differences which will provide additional therapeutic properties to the supporting device. In this orientation, the device (20) can be used as a support for the hand and wrist areas as well. The supporting device (20) can also be utilized for therapeutic purposes by changing the temperature of the device as required or desired by the user. Therefore, the gel material must possess properties which allow it to be heated and cooled.

The use of the gel bag (56) with the supporting devices (20) or (60) results in the availability of differential placement pressure to the user which allows the user to further refine the amount and placement of pressure applied to the area of the wrist. This configuration is intended to provide greater weight bearing capacity overall by the synergistic action of the supporting device (20) on the sidewalls of the carpal tunnel rather than just on the region of the wrist underlying the nervous and tendon tissue in the central portion of the wrist just distal to the last wrist crease. This is the specific location where the median nerve exits the carpal tunnel and disperses towards its final destinations. This area is quite sensitive in some users and the supporting device (20) with a gel bag (56) will provide soft support to this region of the wrist.

The gel bag (56) containing soft gel material can be any shape and size as long as it can fit into the cavity (32) of the supporting device (20). The soft gel material can be cooled separately from the main device to allow for convection cooling of the user's wrist to reduce and prevent or help treat the development of inflammation in the wrist and tendons. If the user desires, the soft gel material can alternately be heated separately from the main supporting device (20) to provide convective warmth and increased comfort to the inflamed wrist of the user by increasing the blood flow in the area, reducing the pain and removing serous fluid present. As the device does not produce full direct pressure to the hand or wrist, no restriction of blood or lymphatic flow will occur compared to flow obstructing direct compression pressure devices.

Additionally, the user can apply differential thermal conditions to the area of the body by cooling the supporting device (20) or (60) and warming the gel bag (56) or visa versa.

The foregoing description of the preferred embodiments of the present invention was presented for illustrative purposes and not meant to limit the invention to specific forms disclosed because various modifications to the disclosed invention are possible in light of the above teachings. The invention is intended to cover alternatives, modifications and equivalents, which may be included within the spirit and scope of the invention as defined by the appended claims.

I claim:

1. A device of continuous construction for supporting hand, wrist, forearms and elbows, said device being mobile during use, comprising:

a nodal section having at least two raised nodes separated by an internodal recess, said nodal section comprising a middle node having a first height, and two lateral nodes having a second height, separated by two internodal recesses said first height of said middle node is greater than said second height of said two lateral nodes;

a rim section attached to said nodal section forming a central cavity, said rim section containing two depressions located adjacent to said lateral nodes, the interconnection of said middle node and each of said lateral nodes creating a hollow along the base of each of said middle and said lateral nodes.

2. A mobile device for supporting hands, wrists, forearms, and elbows comprising:

a nodal section having at least two raised nodes separated by an internodal recess, said nodal section comprising a middle node having a first height, and two lateral nodes having a second height, separated by two internodal recesses, said first height of said middle node is greater than said second height of said two lateral nodes;

a cushion in said cavity of said mobile support device for additional support of said hands, wrists, forearms and elbows;

a rim section attached to said nodal section forming a central cavity; and a cushion in said cavity of said mobile support device for additional support of said hands, wrists, forearms and elbows;

wherein said mobile device supports said hands, wrists, forearms, and elbows at contact points on said nodal section without direct compression of the soft, compressible tissues of said hands, wrists, forearms, and elbows.

3. The supporting device of claim 2, wherein said cushion is a bag containing a soft gel material.

4. The supporting device of claim 3, wherein a temperature said soft gel material is capable of being cooled.

5. The supporting device of claim 3, wherein said soft gel material is capable of being warmed.

* * * * *